US010894180B2

(12) United States Patent
Osti et al.

(10) Patent No.: US 10,894,180 B2
(45) Date of Patent: Jan. 19, 2021

(54) DEVICE FOR POSTURAL EDUCATION

(71) Applicants: Leonardo Osti, Modena (IT); Raffaella Osti, Ferrara (IT)

(72) Inventors: Leonardo Osti, Modena (IT); Raffaella Osti, Ferrara (IT)

( * ) Notice: Subject to any disclaimer, the term of this patent is extended or adjusted under 35 U.S.C. 154(b) by 16 days.

(21) Appl. No.: 16/336,313

(22) PCT Filed: Sep. 22, 2017

(86) PCT No.: PCT/IB2017/055773
§ 371 (c)(1),
(2) Date: Mar. 25, 2019

(87) PCT Pub. No.: WO2018/055570
PCT Pub. Date: Mar. 29, 2018

(65) Prior Publication Data

US 2020/0016454 A1 Jan. 16, 2020

(30) Foreign Application Priority Data

Sep. 23, 2016 (IT) ..... 102016000095974

(51) Int. Cl.

| | |
|---|---|
| ***A63B 22/16*** | (2006.01) |
| ***A63B 22/18*** | (2006.01) |
| ***A63B 26/00*** | (2006.01) |
| *A63B 23/02* | (2006.01) |
| *A63B 71/00* | (2006.01) |

(52) U.S. Cl.
CPC ..... *A63B 22/16* (2013.01); *A63B 22/18* (2013.01); *A63B 26/003* (2013.01); *A63B 23/0233* (2013.01); *A63B 71/0054* (2013.01); *A63B 2071/0072* (2013.01); *A63B 2208/0204* (2013.01)

(58) Field of Classification Search
CPC ..... A63B 22/16; A63B 22/18; A63B 26/003; A63B 23/0233; A63B 71/0054; A63B 2071/0072; A63B 2208/0204; A63B 2022/0038; A63B 2022/185; A63B 2071/027; A63B 23/08
See application file for complete search history.

(56) References Cited

U.S. PATENT DOCUMENTS

| | | | | |
|---|---|---|---|---|
| 3,984,100 A * | 10/1976 | Firster | ..... | A63B 21/0004 482/79 |
| 4,159,111 A | 6/1979 | Lowth | | |
| 4,285,516 A | 8/1981 | Heatwole | | |
| 4,700,947 A * | 10/1987 | Heatwole | ..... | A63B 21/0004 482/146 |

(Continued)

FOREIGN PATENT DOCUMENTS

FR 2575074 A1 6/1986

*Primary Examiner* — Andrew S Lo

(74) *Attorney, Agent, or Firm* — David B. Tingey; Bryant J. Keller; Kirton McConkie

(57) ABSTRACT

The device for postural education comprises: two oscillating elements having respectively: —one plantar resting portion for the resting of a foot of a user; one supporting portion opposite to the plantar resting portion and of a substantially convex shape; connection means of the oscillating elements; in which the supporting portion is adapted to allow the oscillation of the respective oscillating element as a result of the resting of the foot of the user.

12 Claims, 3 Drawing Sheets

(56) References Cited

U.S. PATENT DOCUMENTS

| | | | | |
|---|---|---|---|---|
| 5,292,296 | A | 3/1994 | Davignon | |
| 5,730,690 | A | 3/1998 | Guidry | |
| 5,795,277 | A * | 8/1998 | Bruntmyer | A63B 21/0004 280/87.041 |
| 8,740,757 | B1 | 6/2014 | FioRito et al. | |
| 2002/0077231 | A1 | 6/2002 | Dalebout et al. | |
| 2003/0060338 | A1 | 3/2003 | Sayce | |
| 2003/0148865 | A1* | 8/2003 | Handshoe | A63B 23/08 482/148 |
| 2004/0142802 | A1 | 7/2004 | Greenspan et al. | |
| 2006/0030463 | A1* | 2/2006 | Maloy | A63B 23/1281 482/126 |
| 2007/0111862 | A1* | 5/2007 | Lockett | A63B 22/18 482/51 |
| 2013/0316886 | A1* | 11/2013 | Lynch | A63B 21/4035 482/146 |
| 2014/0162858 | A1* | 6/2014 | Dalebout | A63B 26/003 482/142 |
| 2015/0209612 | A1* | 7/2015 | Shen | A63B 22/201 482/147 |
| 2016/0193504 | A1* | 7/2016 | Ambrozak | A63B 69/0093 482/146 |
| 2016/0250520 | A1* | 9/2016 | Rainey | A63B 26/003 482/146 |
| 2019/0054348 | A1* | 2/2019 | Polinsky | A63B 22/0025 |

* cited by examiner

DEVICE FOR POSTURAL EDUCATION

TECHNICAL FIELD

The present invention relates to a device for postural education.

PRIOR ART

It is known how a physiologically incorrect posture, in particular for people who remain in static and sedentary positions for a fairly long amount of time, can lead to an uneven distribution of the pressures which, by discharging onto the spinal column, the back and the inter-vertebral disks, cause a series of osteoarticular complaints.

More specifically, the problems of modern man whose lifestyle is often characterized by poor organic stimuli, sedentariness and stress cause the onset of many musculo-skeletal and organic problems such as backache, headache, circulatory problems, and the like.

In fact, sedentariness is one of the major causes of these ailments, and to the latter must be added a lack of movement that causes accelerated aging of the inter-vertebral disks, thus increasing degenerative age-related processes and the risk of injuries both in the field of sports and daily life.

Furthermore, the many commitments of modern life make it increasingly more difficult to reconcile daily routines with the possibility of stimulating muscular trophism, and from the latter comes the need to improve personal proprioceptivity through specific exercises aimed at the stimulation and strengthening of the muscles.

Furthermore, according to recent studies, the maintenance of good paravertebral muscular trophism and controlled and modulated movement are among the main and most effective prevention factors both of osteoarticular complaints and of injuries.

To date, devices are known for postural education comprising a supporting surface having a substantially flat plantar resting face and a ground resting face opposite the plantar resting face and associated with a substantially hemispherical-shaped supporting element.

The user, by resting both feet on the plantar resting face, climbs onto the supporting surface and attempts to find a balanced position; the presence of the hemispherical supporting element makes the supporting surface unstable, by continuously inducing the user to seek a situation of balance and, therefore, subjecting his/her muscles to continuous stimuli coming from multiple directions.

The supporting surface loaded by the user's weight causes the support element to swing; in particular, the degree of oscillation of the supporting element itself is inversely proportional to the radius of the hemispherical supporting element. Another type of known device has a substantially semi-cylindrical shaped supporting element.

In this case, the supporting element loaded by the weight of the user swings along just one direction according to the orientation of the user's feet; this means that in the event of the user positioning his/her feet along the direction of longitudinal extension of the supporting element, the latter swings sideways. Alternatively, if the user positions his/her feet orthogonally to the direction of longitudinal extension of the supporting element, the latter swings back and forth.

However, known devices have a number of drawbacks tied to the fact that both the user's feet are positioned on the supporting surface, greatly reducing the user's possibility of movement.

In other words, the fact of having both feet positioned on a single plantar resting surface limits the range of proprioceptive stimuli provided to the user.

Other devices for postural education are known from patent documents U.S. Pat. No. 4,285,516, US2003/060338, U.S. Pat. No. 8,740,757, FR 2575074, U.S. Pat. Nos. 5,292,296, 5,730,690, 4,159,111.

DESCRIPTION OF THE INVENTION

The main aim of the present invention is to provide a device for postural education that allows varying the stimuli addressed to the user, by increasing personal proprioceptivity in order to strengthen the paravertebral muscles and prevent the risk of injury.

Another object of the present invention is to provide a device for postural education that allows varying the plantar resting surfaces.

A further object of the present invention is to provide a device for postural education which allows overcoming the aforementioned drawbacks of the prior art within the scope of a simple, rational, easy, efficient to use and cost-effective solution.

The aforementioned objects are achieved by the present device for postural education, according to the characteristics described in claim 1.

BRIEF DESCRIPTION OF THE DRAWINGS

Other characteristics and advantages of the present invention will become more evident from the description of a preferred, but not exclusive, embodiment of a device for postural education, illustrated by way of an indicative, but non-limiting example, in the attached drawings in which.

EMBODIMENTS OF THE INVENTION

Figure 1:
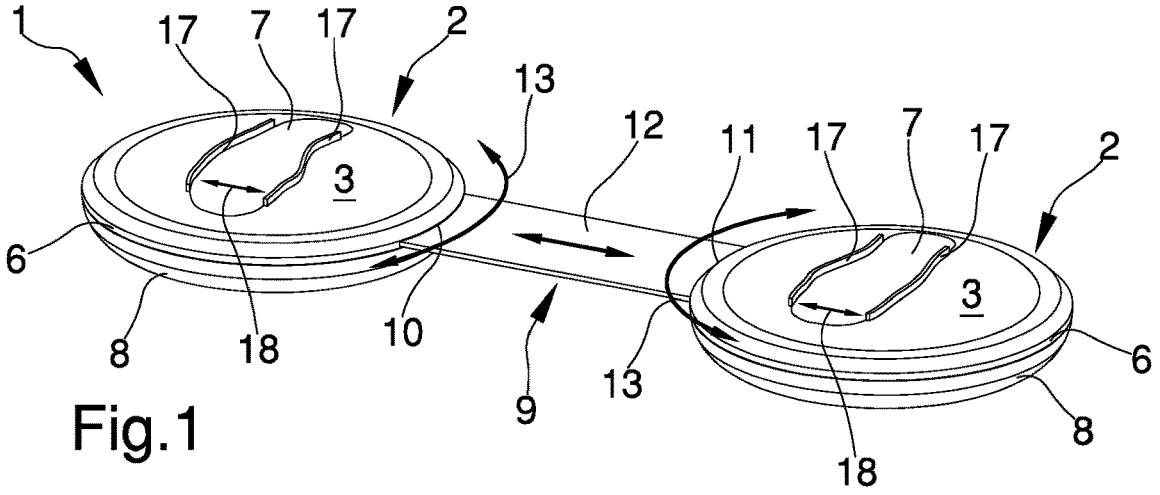
FIG. 1 is an axonometric view of the device according to the invention in a first embodiment.

With particular reference to these illustrations, reference numeral 1 globally indicates a device for postural education.

The device 1 comprises two oscillating elements 2.

The two oscillating elements 2 have respectively one plantar resting portion 3 for the resting of a foot 4 of a user 5, and one supporting portion 6 opposite to the plantar resting portion 3 and of a substantially convex shape.

Advantageously, the plantar resting portion 3 comprises one housing seat 7 of the foot 4 of the user 5.

Each housing seat 7 is substantially coaxial to the supporting portion 6, thus allowing an even distribution of the weight of the user 5.

With reference to the particular embodiment shown in the illustrations, the oscillating elements 2 have a substantially circular shape. Alternative embodiments with different shapes, e.g. quadrangular, cannot however be ruled out.

The device 1 also comprises containment means 17 to contain the foot 4 of the user 5 inside the housing seat 7.

The containment means 17 comprise an adjustable abutment edge which extends laterally to the housing seat 7.

In particular, the mutual distance (shown in the figure with the arrow 18) between the abutment edge 17 of one side of the housing seat 7 and the corresponding abutment edge 17 of the other side is variable according to the size of the foot 4 of the user 5.

Figure 6:
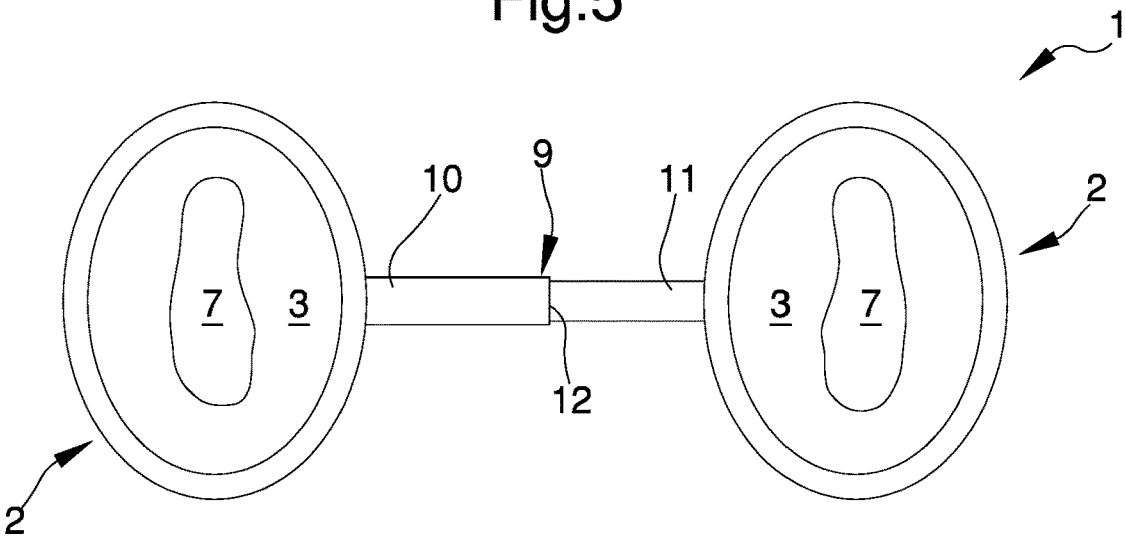
FIG. 6 is a plan view from above of the device according to the invention in a fourth embodiment.
Figure 7:
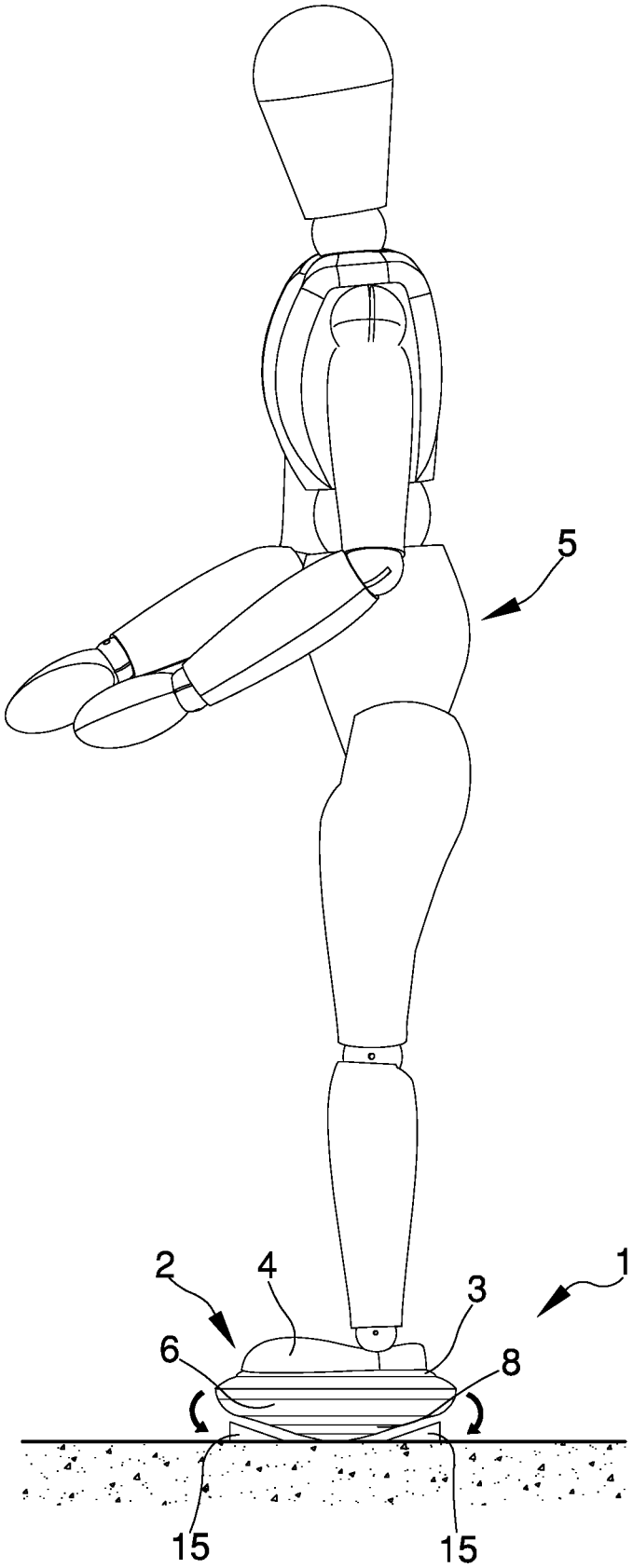
FIG. 7 is a schematic representation of the device according to the invention in operating mode.

Alternatively, as shown in FIG. 6, the oscillating elements 2 have a substantially elliptical shape. In this case, the housing seat 7 is formed along the direction of longitudinal extension of each plantar resting portion 3. Specifically, the supporting portion 6 is adapted to allow the oscillation of the respective oscillating element 2 as a result of the resting of the foot 4 of the user 5.

Preferably, the supporting portion 6 comprises a resting surface 8 having a predefined radius of curvature; this means that the supporting portion 6 may have a more or less accentuated protrusion depending on the extension of the radius of curvature itself.

With reference to the particular embodiment shown in the illustrations, the resting surface 8 has a substantially hemispherical shape.

According to the invention, the device 1 comprises connection means 9 of the oscillating elements 2.

The connection means 9 have an elongated shape and comprise one connecting element having a first ending part 10 associated with one of the oscillating elements 2 and a second ending part 11 associated with the other of the oscillating elements 2.

Preferably, the connecting element 9 is of the type of a single monolithic body of elongated shape.

Figure 2:
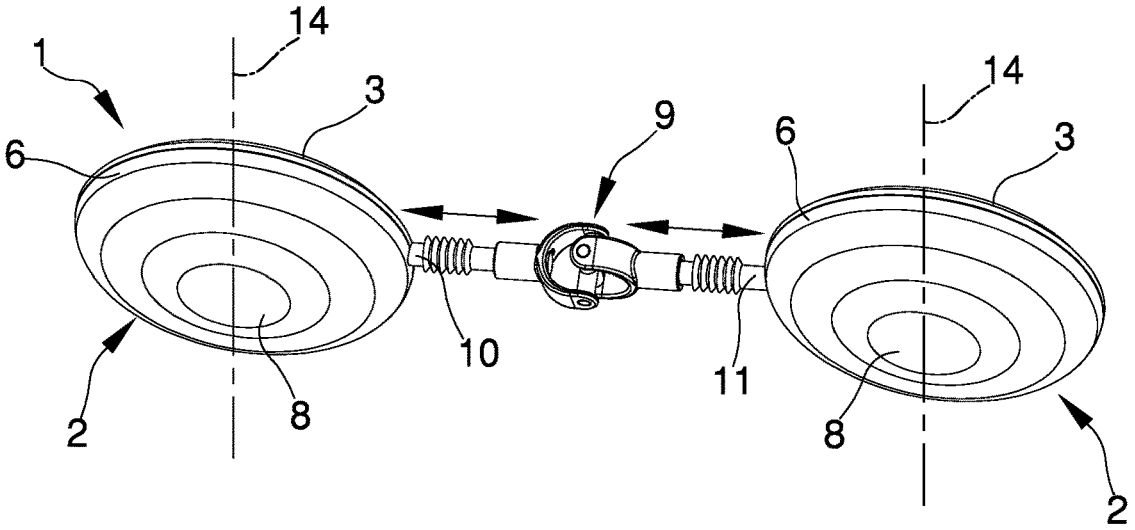
FIG. 2 is an axonometric view from below of the device according to the invention in a second embodiment.
Figure 3:
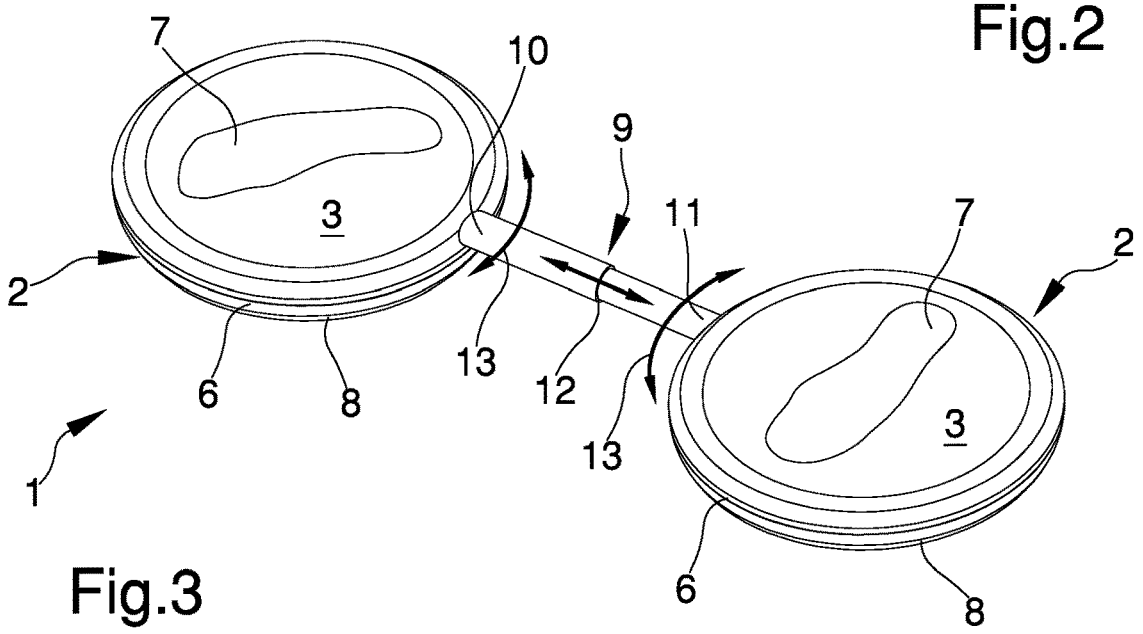
FIG. 3 is an axonometric view from above of the device according to the invention in a third embodiment.

Alternatively, the connecting element 9 is of the type of a universal joint (FIG. 2).

Advantageously, the device 1 comprises adjustment means 12 for adjusting the distance of the oscillating elements 2.

With reference to the first embodiment shown in FIG. 1, the adjustment means 12 comprise an elastic element.

Alternative embodiments cannot however be ruled out wherein the adjustment means 12 comprise one telescopic arm (FIGS. 3, 4, 5 and 6).

The device 1 comprises means for the mutual orientation 13 of the oscillating elements 2, schematically shown in the illustrations by means of the arrow 13; the ending parts 10, 11 are associated in a movable manner with the oscillating elements 2.

The mutual orientation means 13 comprise a groove, not shown in detail in the illustrations, formed on the border of each oscillating element 2.

The first ending part 10 and the second ending part 11 are associated in a sliding manner with the groove, so as to permit the free orientation of an oscillating element 2 with respect to the other.

The mutual orientation means 13 allow orienting each oscillating element 2 independently with respect to the other.

In other words, the mutual orientation means 13 allow for the partial rotation of each oscillating element 2 with respect to a central axis 14 passing through these.

Furthermore, the device 1 comprises limiting means 15 of the oscillation of the oscillating elements 2.

The limiting means 15 are adapted to vary the degrees of freedom of the oscillating elements 2; this allows modulating the oscillation of the oscillating elements 2 according to the specific needs of the user 5.

The limiting means 15 comprise a plurality of triangular-based limiting elements of the type of wedges.

The limiting elements 15 have different heights; in other words, the device 1 comprises limiting elements 15 having variable heights and usable in series to adjust the oscillation of each oscillating element 2.

Figure 4:
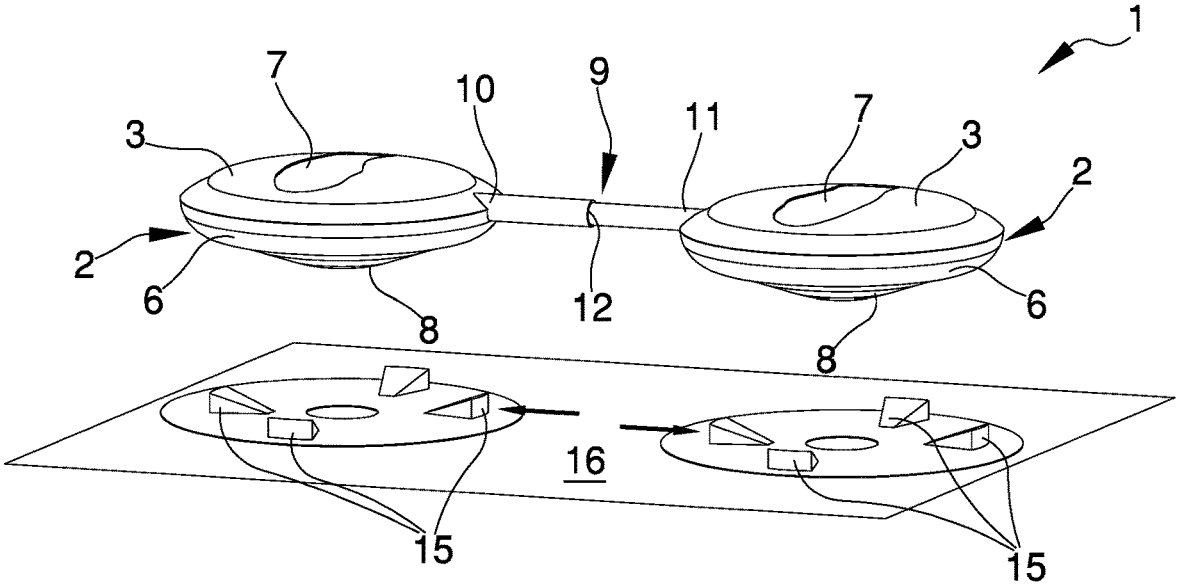
FIG. 4 is an axonometric view of the device according to the invention in operating mode.

As can be seen in FIG. 4, the limiting elements 15 are associated in a sliding manner with a substantially sheet-shaped base element 16. The base element 16 has four limiting elements 15 arranged radially on the latter and equidistant to one another.

The distance of each limiting element 15 with respect to the relative oscillating element 2 can be modulated according to the degree of oscillation you want to obtain.

Alternative embodiments cannot however be ruled out wherein the limiting means 15 comprise a plurality of planar elements having a central hole and located below the supporting portion 6. The planar elements can be stacked one on top of the other in such a way to form a shim designed to decrease the degrees of freedom of each oscillating element 2.

The possibility to stop the oscillation of the oscillating elements 2 cannot however be ruled out; in fact, the device 1 comprises locking means of the oscillation of the oscillating elements 2.

Figure 5:
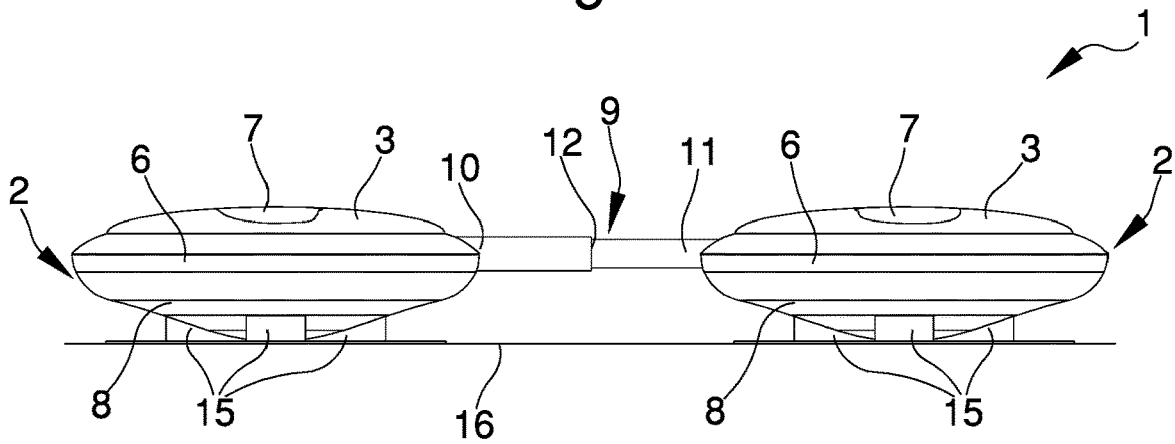
FIG. 5 is a front view of the device according to the invention in operating mode.

Preferably, the locking means comprise a plurality of retaining elements having a height corresponding to the distance between the supporting portion 6 and the base element 16 of the device 1 (FIG. 5).

In addition, it is worth specifying that the present invention also relates to a kit 1, 15 for postural education.

The kit 1, 15 comprises the device 1, the base element 16 on top of which the device itself can be positioned.

Additionally, the kit 1, 15 according to the invention comprises the limiting elements 15 and the retaining elements.

The operation of the present invention is as follows.

The device 1 is positioned on the ground or, alternatively, on the base element 16.

The user 5 places the feet 4 inside the respective housing seats 7.

At this point, the weight of the user 5 is discharged on the supporting portion 6, thus causing the oscillation of each oscillating element 2.

The oscillation of the oscillating elements 2 can be modulated according to the needs of the user 5.

In particular, in the event of the device 1 being positioned on top of the base element 16, the oscillation of the latter can be increased and/or decreased by moving away and/or approaching respectively the limiting elements 15 to the respective oscillating element 2.

Finally, the oscillation can be completely stopped by positioning the limiting elements 15 below the resting surface 8.

It has in practice been found that the described invention achieves the intended objects.

It is emphasized that the particular solution of providing the synergistic combination of two oscillating elements connected together by means of a connecting element and means of reciprocal orientation of the oscillating elements themselves permits making a device for postural education with controlled and adjustable degrees of oscillation.

To this must be added that the fact of providing adjustable degrees of oscillation permits energy absorption and the partial return of same in the form of proprioceptive stimuli, greatly reducing articular and muscular stress.

Furthermore, the fact of increasing personal proprioceptivity allows using this device both in a gymnastic and rehabilitative context.

The invention claimed is:

1. A device for postural education, comprising:

at least two oscillating elements having respectively:

at least one plantar resting portion for a resting of a foot of a user;

at least one supporting portion that is disposed substantially opposite to said plantar resting portion and of a substantially convex shape;

a connection means that connects said oscillating elements, said connection means having an elongated shape and comprising at least one connection element having a first ending part that is coupled at a perimeter of one of said oscillating elements and a second ending part that is coupled at a perimeter of the other of said oscillating elements;

wherein said supporting portion is adapted to allow an oscillation of the respective said oscillating element as a result of the resting of the foot of said user and comprising a resting surface having a predefined radius of curvature and a substantially hemispherical shape, wherein the device is configured to allow for mutual orientation of said oscillating elements, and wherein said ending parts are coupled in a sliding manner with said oscillating elements to adjust a distance between said oscillating elements.

2. The device according to claim 1, further comprising adjustment means for adjusting the distance between said oscillating elements.

3. The device according to claim 2, wherein said adjustment means comprise at least one elastic element.

4. The device according to claim 2, wherein said adjustment means comprise at least one telescopic arm.

5. The device according to claim 1, wherein said plantar resting portion comprises at least one housing seat of the foot of said user.

6. The device according to claim 2, further comprising containment means of the foot of said user formed at a boarder of said housing seat.

7. The device according to claim 6, wherein said containment means comprise an adjustable abutment edge.

8. The device according to claim 1, further comprising limiting means of the oscillation of said oscillating elements.

9. The device according to claim 8, wherein said limiting means comprise a plurality of limiting elements associated in a sliding manner with a substantially sheet-shaped base element.

10. The device according to claim 1, further comprising locking means of the oscillation of said oscillating elements.

11. The device according to claim 10, wherein said locking means comprise a plurality of retaining elements having a height corresponding to a distance between a base element to which the retaining elements are coupled and said at least one supporting portion.

12. A kit for postural education, comprising:

at least one device according to claim 1;

a base element on top of which said device is configured to be positioned;

a plurality of limiting elements coupled in a sliding manner with the base element; and a plurality of retaining elements having a height corresponding to the distance between said base element and said at least one supporting portion.

* * * * *